US005145327A

United States Patent [19]

Nakajima et al.

[11] Patent Number: 5,145,327

[45] Date of Patent: Sep. 8, 1992

[54] VARIABLE CAPACITY VANE COMPRESSOR HAVING AN IMPROVED BEARING FOR A CAPACITY CONTROL ELEMENT

[75] Inventors: Nobuyuki Nakajima; Tatsuo Nakaya, both of Konan, Japan

[73] Assignee: Zexel Corporation, Tokyo, Japan

[21] Appl. No.: 680,414

[22] Filed: Apr. 4, 1991

[30] Foreign Application Priority Data

Apr. 11, 1990 [JP] Japan ..... 2-95333

[51] Int. Cl.[5] ..... F04B 49/00; 417 295; 417 310

[52] U.S. Cl. ..... 417/295; 417/310

[58] Field of Search ..... 417/295, 310

[56] References Cited

U.S. PATENT DOCUMENTS 4,887,943 12/1989 Kobayashi et al. ..... 417/295
4,890,985 1/1990 Sugiura ..... 417/295
5,020,976 6/1991 Nakajima et al. ..... 417/295
5,056,990 10/1991 Nakajima et al. ..... 417/295

FOREIGN PATENT DOCUMENTS 63-205493 8/1988 Japan .

*Primary Examiner*—Richard A. Bertsch
*Assistant Examiner*—Alfred Basichas
*Attorney, Agent, or Firm*—Frishauf, Holtz, Goodman & Woodward

[57] ABSTRACT

A variable capacity vane compressor has a thrust bearing received in an annular recess formed in the inner peripheral surface of a through hole of a side block through which a drive shaft extends. The thrust bearing axially supports a capacity control element for controlling timing of start of compression of refrigerant gas. An annular member is force-fitted in the annular recess to urge one race of the thrust bearing against the side block. Another race of the thrust bearing is slidably fitted in the inner peripheral surface of the annular member. This race is force-fitted in a hole of the capacity control element through which the drive shaft extends. The inner peripheral surfaces of the two races are spaced from the outer peripheral surface of the drive shaft.

4 Claims, 9 Drawing Sheets

VARIABLE CAPACITY VANE COMPRESSOR HAVING AN IMPROVED BEARING FOR A CAPACITY CONTROL ELEMENT

BACKGROUND OF THE INVENTION

This invention relates to a variable capacity vane compressor, and more particularly to improvements in bearing means for a capacity control element used in a variable capacity vane compressor.

A conventional variable capacity vane compressor for use in automotive air conditioners, as proposed by Japanese Provisional Patent Publication (Kokai) No. 63-205493comprises, as shown in FIG. 1, a cylinder formed by a pair of side blocks 3, 4, and a cam ring 1 having opposite ends closed by the associated side blocks 3, 4, a rotor 2 rotatably received in the cylinder, and a drive shaft 7 on which the rotor is rigidly fitted. The side blocks 3, 4 have respective through holes 40, 41 through which the drive shaft 7 extends. Radial bearings 8, 9 are force-fitted in the respective through holes 40, 41 for supporting the drive shaft 7. The rear side block 4 has an annular recess 23 formed in a rotor side face 4*a* thereof. A capacity control element 24 in the form of an annulus is rotatably fitted in the annular recess 23 for controlling timing of the start of compression of a refrigerant gas. The control element 24 is supported by a thrust bearing 43 fitted in an annular recess 42 formed in an inner peripheral surface of the through hole 41 of the rear side block 4. The thrust bearing 43, which is sandwiched between an end wall 42*a* of the annular recess 42 facing toward the rotor 2 and an opposed side face 24*a* of the control element 24, supports the control element 24 only in the axial direction.

The control element is directly fitted on the drive shaft 7, with its central through hole 24*b* penetrated by the shaft 7.

The control element 24 is rotatable between the maximum capacity position and the minimum capacity position to vary the capacity or delivery quantity of the compressor between the maximum value and the minimum value.

A torsional spring 38 has one end thereof engaged by a rear head 6 and the other end by the control element 24 to bias the latter in the capacity-decreasing direction.

However, the control element 24 is also biased in the radial direction so that the central through hole 24*b* of the control element 24 is not coaxial with the drive shaft 7. That is, the inner peripheral surface of the central through hole 24*b* is constantly in line contact with the outer peripheral surface of the drive shaft as shown in FIG. 2 such that the control element 24 is guided by the drive shaft 7. Consequently, when the compressor 7 rotates at a high speed or the compressor is in a high load condition, there may occur galling between the control element 24 and the drive shaft 7, which prevents smooth rotation of the control element, degrading the controllability of the compressor, and causes the drive shaft 7 and the control element 24 to be rapidly worn, degrading the reliability.

SUMMARY OF THE INVENTION

It is the object of the invention to provide a variable capacity vane compressor having improved bearing means for a capacity control element thereof, which enables to prevent occurrence of galling between the control element and the drive shaft, and reduce the amount of wear of the control element and the drive shaft, thereby improving the controllability as well as the reliability of the compressor.

To attain the above object, the invention provides a variable capacity vane compressor including a drive shaft, a rotor rigidly mounted on the drive shaft, a cylinder in which the rotor is rotatably received, the cylinder having a pair of side blocks, the side blocks each having formed therein a hole through which the drive shaft extends, a radial bearing mounted in the hole for supporting the drive shaft, one of the side blocks having an end face facing the rotor and having a first annular recess formed therein, a capacity control element rotatably fitted in the first annular recess for controlling timing of start of compression of a refrigerant gas in the compressor, the capacity control element having an end face remote from the rotor, and a hole through which the drive shaft extends, the hole of the one side block having a second annular recess formed in an inner peripheral surface thereof, the second annular recess having a first wall facing toward the rotor and a second wall facing toward the drive shaft, and bearing means comprising a thrust bearing received in the second annular recess and interposed between the end face of the control element remote from the rotor and the first wall of the second annular recess, the thrust bearing having first and second races.

The variable capacity vane compressor according to the invention is characterized by comprising an annular member force-fitted in the second wall of the second annular recess to urge the first race of the thrust bearing against the first wall of the second annular recess, the annular member having an inner peripheral surface in which the second race of the thrust bearing is slidably fitted, the second race being force-fitted in the hole of the capacity control element, the first and second races having respective inner peripheral surfaces thereof spaced from an outer peripheral surface of the drive shaft.

Preferably, an annular projection is formed integrally on an end face of the second race facing toward the rotor, and the annular projection is force-fitted in the hole of the capacity control element.

Preferably, the second race and the annular member are formed of hardened steel.

The above and other objects, features, and advantages of the invention will become more apparent from the ensuing detailed description taken in conjunction with the accompanying drawings.

DETAILED DESCRIPTION

The invention will now be described in detail with reference to drawings showing an embodiment thereof.

Figure 1:
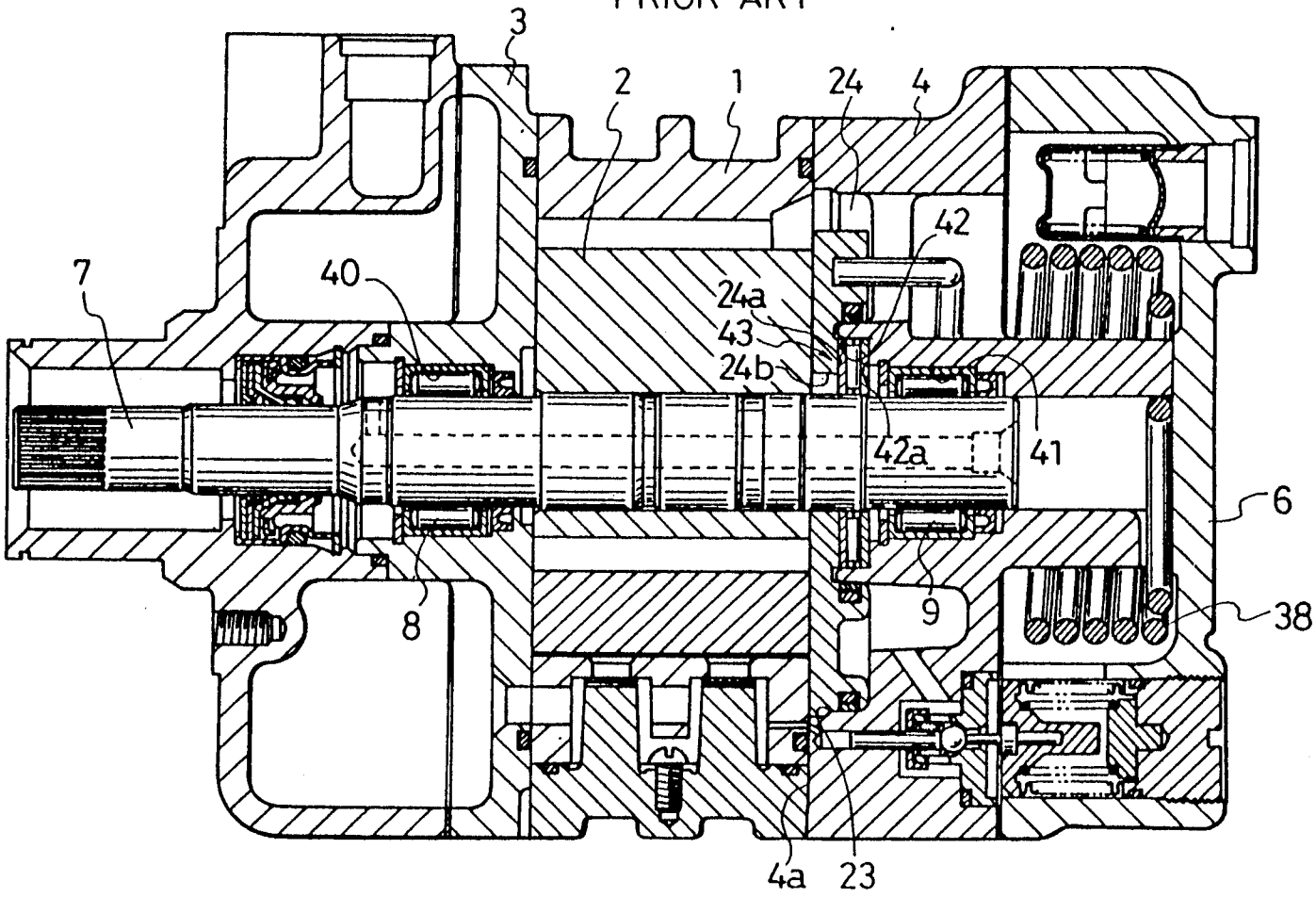
FIG. 1 PRIOR ART
FIG. 1 is a longitudinal cross-sectional view of a conventional variable capacity vane compressor including bearing means for a capacity control element.
Figure 2:
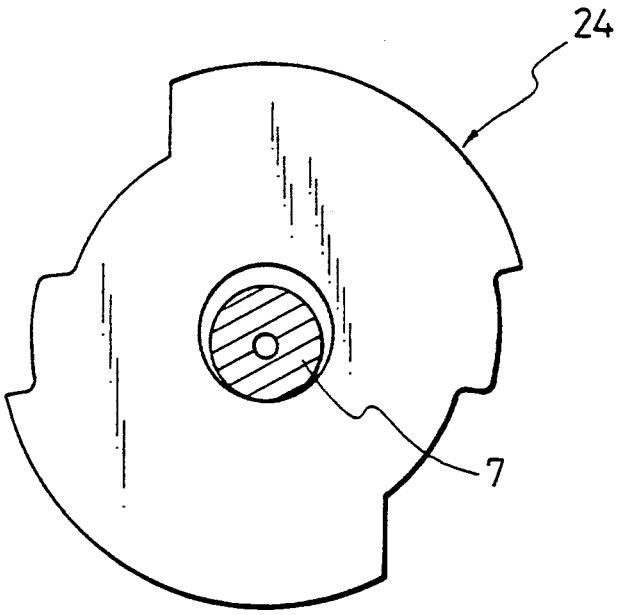
FIG. 2 PRIOR ART
FIG. 2 is a view showing the positional relationship between the control element and the drive shaft, of the conventional compressor of FIG. 1.
Figure 3:
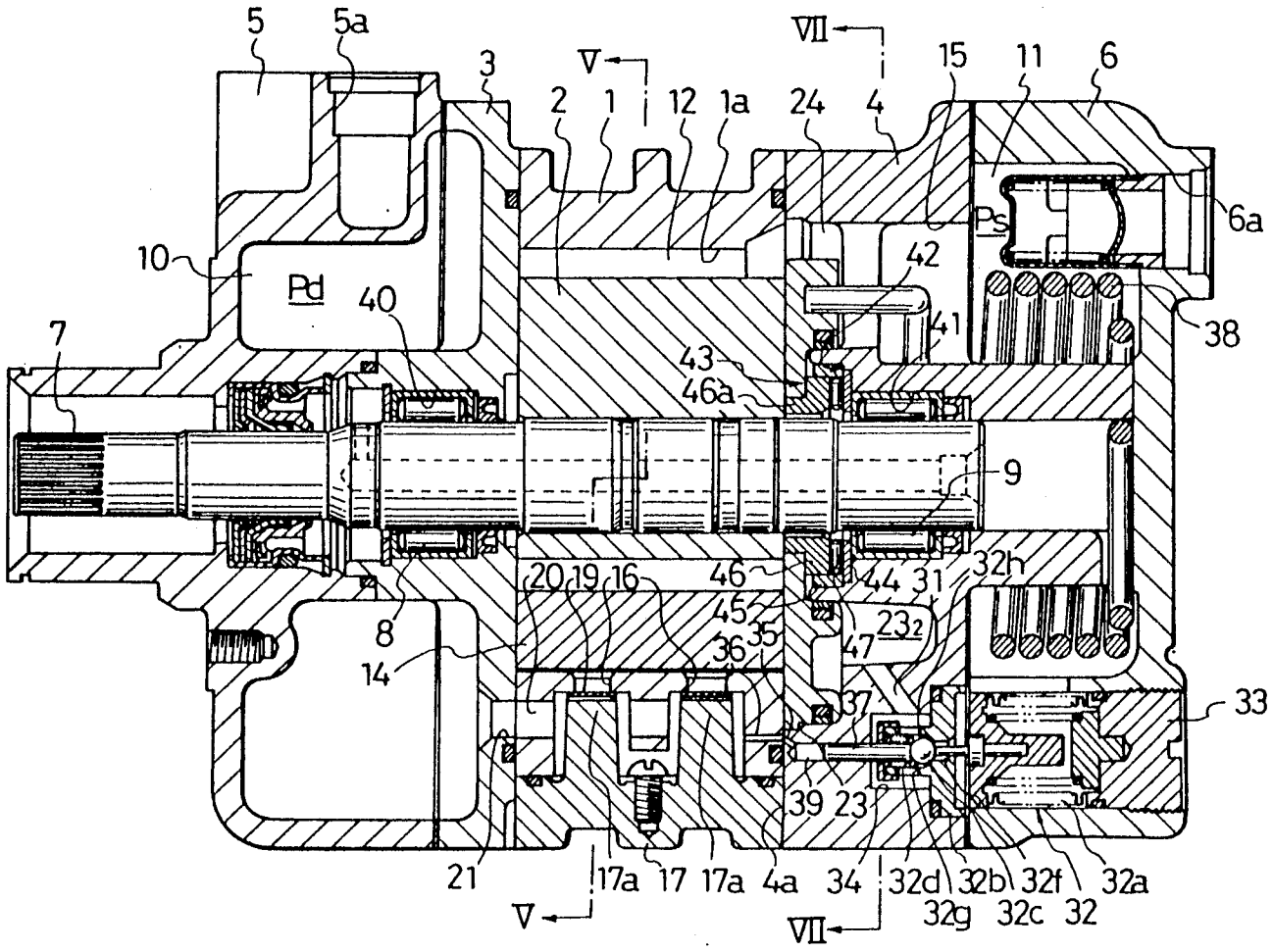
FIG. 3 is a longitudinal cross-sectional view of a variable capacity vane compressor including bearing means for a capacity control element according to an embodiment of the invention.

FIG. 3 shows a variable capacity vane compressor having bearing means for a capacity control element according to an embodiment of the invention.

Figure 5:
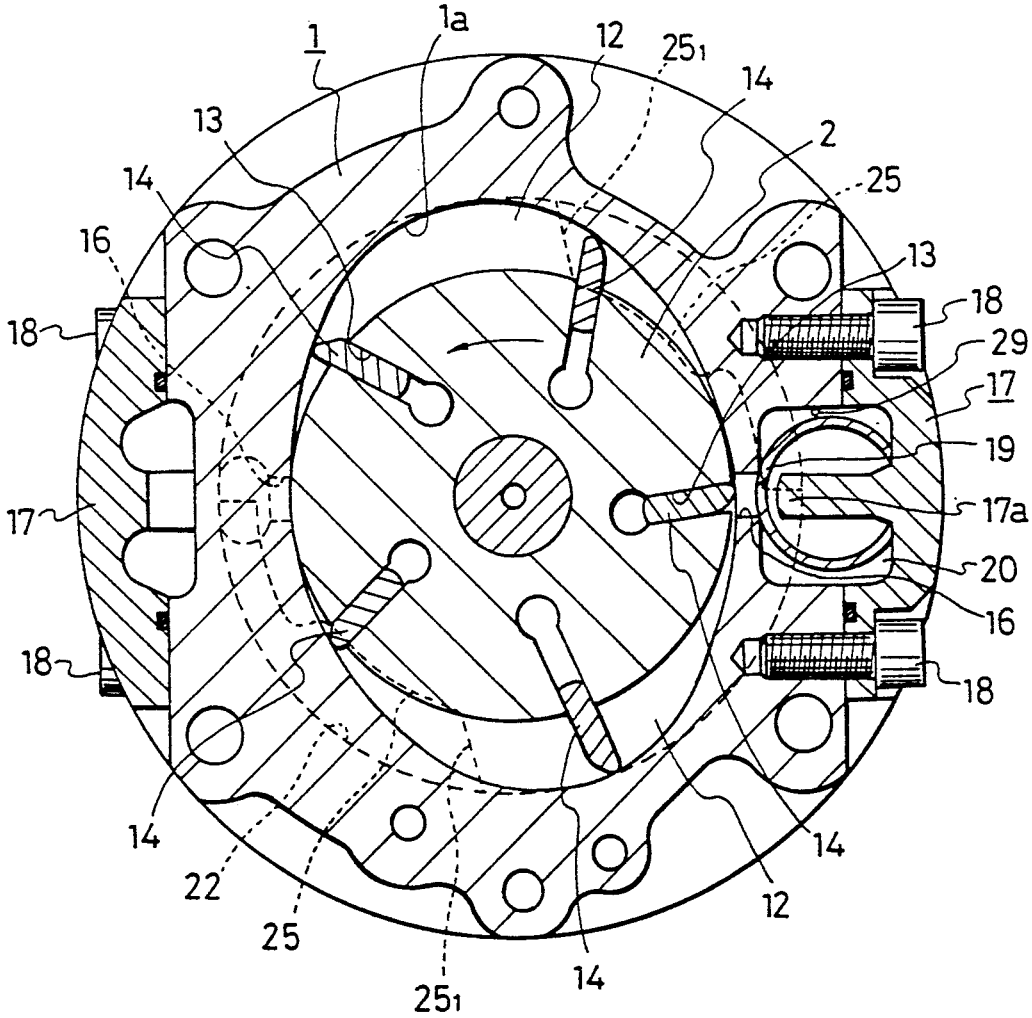
FIG. 5 is a transverse cross-sectional view taken along line V—V in FIG. 3 showing the control element in its maximum capacity position.

As shown in FIGS. 3 and 5, the variable capacity vane compressor is composed mainly of a cylinder formed by a cam ring 1 having an inner peripheral surface 1*a* with a generally elliptical cross section, and a front side block 3 and a rear side block 4 closing open opposite ends of the cam ring 1, a cylindrical rotor 2 rotatably received within the cylinder, a front head 5 and a rear head 6 secured to outer ends of the respective front and rear side blocks 3 and 4, and a drive shaft 7 on which is rigidly fitted on the rotor 2.

A discharge port 5*a* is formed in an upper wall of the front head 5, through which a refrigerant gas is to be discharged as a thermal medium, while a suction port 6*a* is formed in an upper wall of the rear head 6, through which the refrigerant gas is to be drawn into the compressor. The discharge port 5*a* and the suction port 6*a* communicate, respectively, with a discharge pressure chamber 10 defined by the front head 5 and the front side block 3, and a suction chamber 11 defined by the rear head 6 and the rear side block 4.

A pair of compression spaces 12, 12 are defined at diametrically opposite locations between the inner peripheral surface 1*a* of the cam ring 1, the outer peripheral surface of the rotor 2, an end face of the front side block 3 on the cam ring 1 side, and an end face of a capacity control element 24 on the cam ring 1 side. The rotor 2 has its outer peripheral surface formed therein with a plurality of axial vane slits 13 at circumferentially equal intervals, in each of which a vane 14 is radially slidably fitted. As the rotor 2 rotates, the front end of the vane 14 slides along the inner peripheral surface 1*a* of the cam ring 1.

Figure 4:
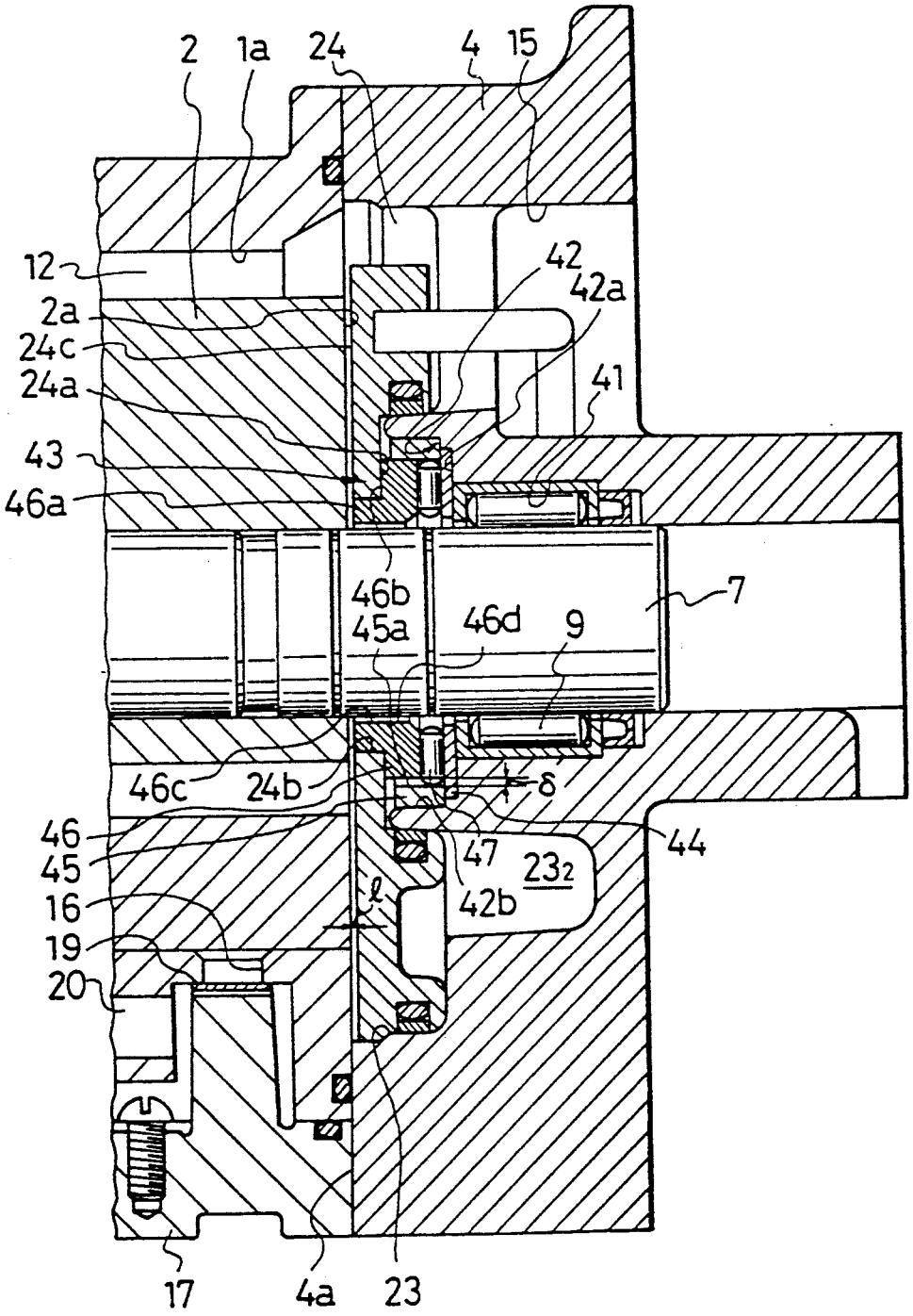
FIG. 4 is an enlarged fragmentary view showing a cross-section of the bearing means appearing in FIG. 3.
Figure 9:
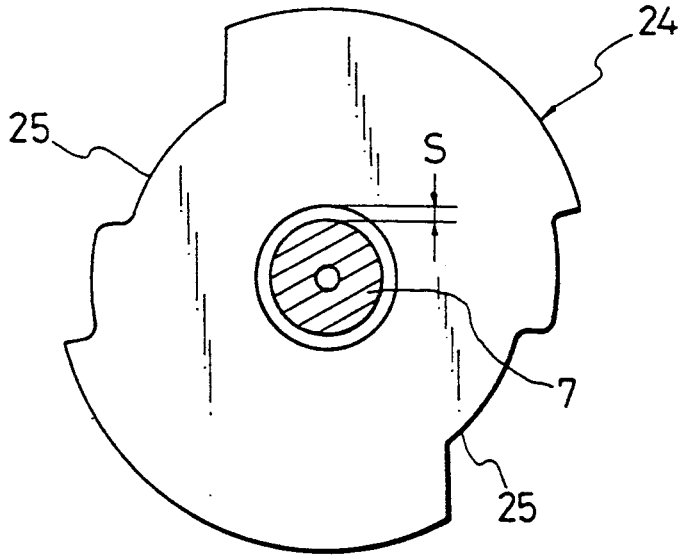
FIG. 9 is a view showing the positional relationship between the control element and the drive shaft, of the compressor according to the embodiment of the invention.

The side blocks 3, 4 are formed therein with respective through holes 40, 41 in which needle roller bearings 8, 9 are force-fitted, respectively, and rotatably support the drive shaft 7. As shown in FIG. 3, the through hole 41 formed through the rear side block 4 has its inner peripheral surface formed therein with an annular recess 42, in which is received a thrust bearing 43. Further, an annular member 45 is force-fitted in the annular recess 42 to urge one race 44 of the thrust bearing 43 against an end wall 42*a* thereof facing toward the rotor 2. Another race 46 of the thrust bearing 43 is fitted in the annular member 45 and in urging contact with a side face 24*a* of the control element 24 facing the rear side block 4. The race 46 and the annular member 45 are formed of a material which is hard and wearresistant, such as hardened steel. Interposed between the races 44 and 46 is a needle roller assembly 47. Part of the circumference of the race 46 is in slidable contact with an inner peripheral surface 45*a* of the annular member 45, and the rest of the circumference is spaced from the inner peripheral surface 45*a* of the latter by the maximum distance $\delta$ (e.g. 30–50 $\mu$) as shown in FIG. 4. Further, the recess 46 has an annular central projection 46*a* formed integrally on a side face 46*b* thereof facing the rotor 2, which is force-fitted in a central through hole 24*b* of the control element 24. The inner peripheral surfaces 46*c*, 46*d* of the respective annular projection 46*a* and race 46 are spaced from the outer peripheral surface of the drive shaft 7 by a distance range S of e.g. $80\mu \pm 20$ $\mu$along the whole circumference thereof, as shown in FIG. 9.

The thrust bearing 43 is mounted into the compressor in the following manner: First, the race 44 is inserted into the annular recess 42, and then the needle roller assembly 47 is inserted into the recess 42 until it contacts the race 44. Then, the control element 24 having the race 46 rigidly fitted therein beforehand is placed into the annular recess 42 until the race 46 contacts the needle roller assembly 47. Then, a clearance l between the control element 24 and the rotor 2 is measured to confirm that the clearance l has a predetermined value. If it does not have the predetermined value, the race 44 is replaced by another one until the clearance shows the predetermined value. When the adjustment of the clearance l is finished, the needle roller assembly 47 and the control element 24 are removed from the annular recess 42, and then the annular member 45 is force-fitted into same. Then, the needle roller assembly 47 is placed onto the race 44, and finally, the race 46 together with the control element 24 is fitted into the annular member 45, followed by again measuring the clearance l.

Refrigerant inlet ports 15, 15 are formed in the rear side block 4 at diametrically opposite locations, as shown in FIG. 3 (since FIG. 3 shows a cross-section taken at an angle of 90° formed about the longitudinal axis of the compressor, only one refrigerant inlet port 15 is shown in the figure.) These refrigerant inlet ports 15 axially extend through the rear side block 4, and through which the suction chamber 11 and the compression spaces 12 are communicated with each other.

Two pairs of refrigerant outlet ports 16, 16 are formed through opposite lateral side walls of the cam ring 1 at diametrically opposite locations as shown in FIGS. 3 and 5 (in FIGS. 3, for the same reason as in the case of the refrigerant inlet ports, only one pair of the refrigerant outlet ports is shown). A discharge valve cover 17 having valve stoppers 17*a* is secured by bolts 18 to each of the opposite lateral side walls of the cam ring having the refrigerant outlet ports 16, 16 formed therein. Disposed between the lateral side wall and each of the valve stopper 17*a* is a discharge valve 19 which is retained on the discharge valve cover 17. The discharge valve 19 opens the associated refrigerant outlet port 16 in response to discharge pressure. Discharging spaces 20 which communicate with the respective pairs of refrigerant outlet ports 16 when the discharge valves 19 open are defined between the cam ring 1 and the respective discharge valve covers 17 at diametrically opposite locations. A pair of passages 21 are formed in the front side block 3 at diametrically opposite locations thereof, which each communicate with a corresponding one of the discharging spaces 20, whereby when each discharge valve 19 opens to thereby open the corresponding refrigerant outlet port 16, a compressed refrigerant gas in the compression space 12 is discharged from the discharge port 5*a* via the refrigerant outlet port 16, the discharging space 20, the passage 21, and the discharge pressure chamber 10, in the mentioned order.

Figure 7:
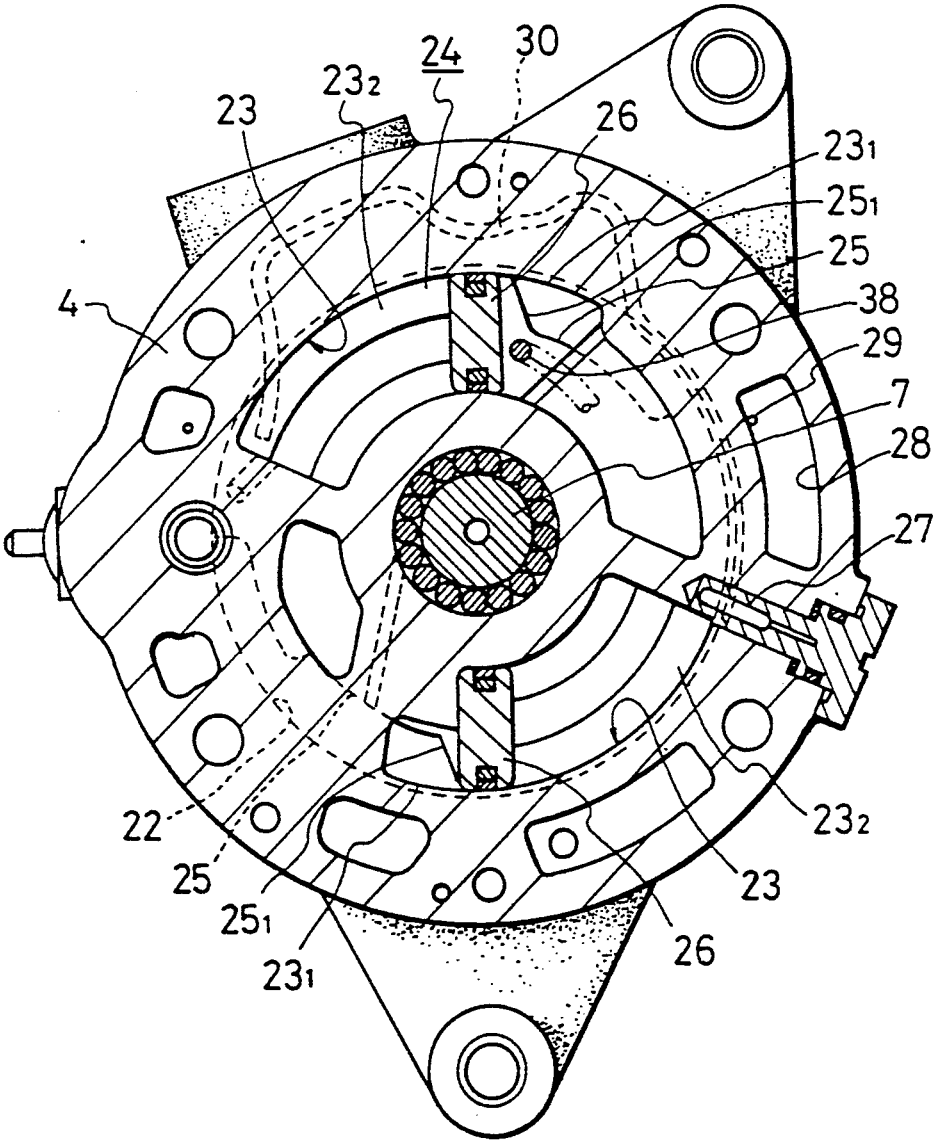
FIG. 7 is a transverse cross-sectional view taken along line VII—VII in FIG. 3.

As shown in FIGS. 3 and 7, the rear side block 4 has an end face facing the rotor 2, in which is formed an annular recess 23. A pair of pressure working chambers 23, 23 are formed in a bottom of the annular recess 23 at diametrically opposite locations. A capacity control element 24, which is in the form of an annulus, is received in the annular recess 23 for rotation about its own axis in opposite circumferential directions. A clearance l is provided between a side face 24c of the control element 24 facing the rotor 2 and an opposed end face 2a of the rotor 2 to reduce the frictional resistance between the rotor 2 and the control element 24. The control element 24 controls the timing of start of compression of the compressor, and has its outer peripheral edge formed with a pair of diametrically opposite arcuate cut-out portions 25, 25, and its one side surface formed integrally with a pair of diametrically opposite pressure-receiving protuberances 26, 26 axially projected therefrom and acting as pressure-receiving elements. The pressure-receiving protuberances 26, 26 are slidably received in respective pressure working chambers 23, 23. The interior of each pressure working chamber 23 is divided into a low-pressure chamber $23_1$ and a high-pressure chamber $23_2$ by the associated pressure-receiving protuberance 26. Each low-pressure chamber $23_1$ communicates with the suction chamber 11 through the corresponding refrigerant inlet port 15 to be supplied with refrigerant gas under suction pressure Ps or low pressure. On the other hand, one of the high-pressure chambers $23_2$, $23_2$ is connected to one of the discharging spaces 20 through a restriction hole 27, a communicating groove, not shown, which is formed in the rear head 6 and communicates with the restriction hole 27, a passage 28 formed in the rear side block 4 and communicating with the communicating groove, and a control pressure-supply port 29 formed in the cam ring 1. The high-pressure chambers $23_2$, $23_2$ are connected to each other through a passage 30 formed in the rear head 6. In each of the high-pressure chambers $23_2$, control pressure Pc prevails, which is created by introducing into the chamber $23_2$ refrigerant gas under discharge pressure Pd or high pressure from the discharging space 20 by way of the restriction hole 27.

Figure 8:
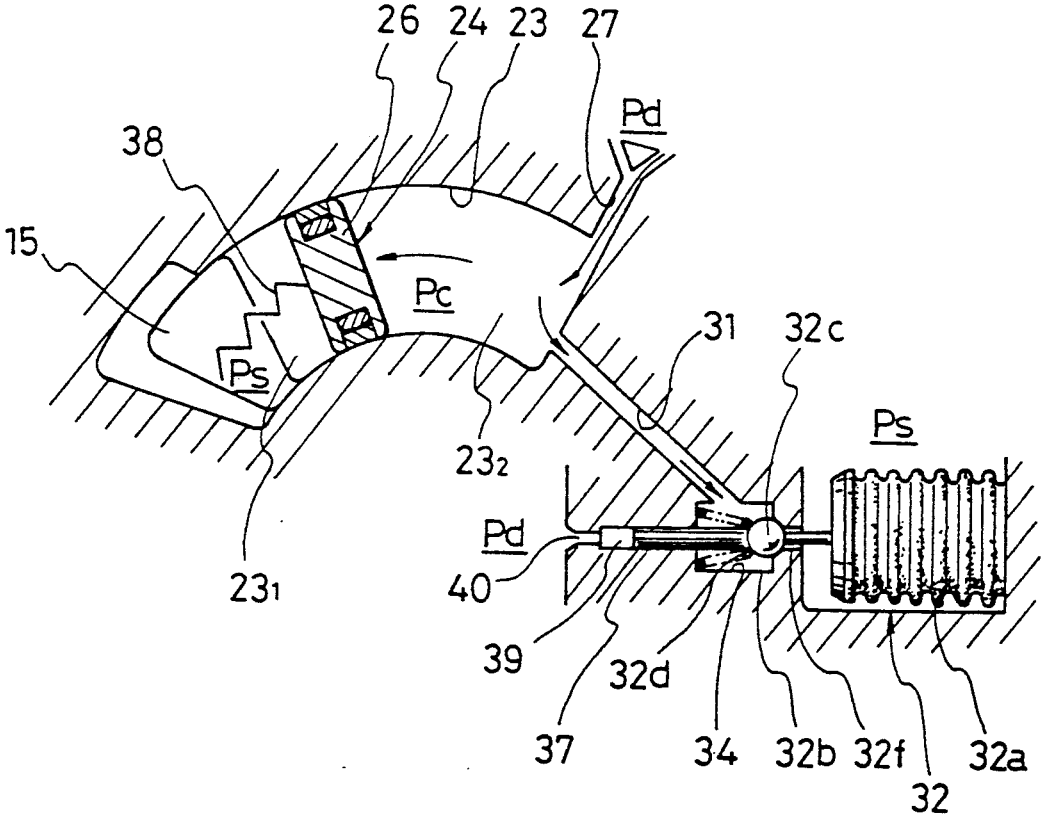
FIG. 8 is a schematic diagram showing a system for controlling the capacity of the compressor.

As shown in FIGS. 3 and 8, one of the high-pressure chambers $23_2$, $23_2$ can be connected to the suction chamber 11 via a passage 31 formed in the rear side block 4 and a control valve device 32.

The control valve device 32 is operable in response to the suction pressure Ps prevailing within the suction chamber 11, whereby the control pressure Pc in the high-pressure chamber $23_2$ is allowed to leak into the suction chamber when the control valve device 32 opens. The control valve device 32 comprises bellows 32a as a pressure-responsive member, a casing 32b, a ball valve body 32c, and a coiled spring 42d urging the ball valve body 32c in its closing direction. The bellows 32a is arranged in the suction chamber 11 for expansion and contraction. The casing 32b is mounted in a mounting hole 34 formed in the rear side block 4 and communicating the passage 31. When the suction pressure Ps is above a predetermined level which is set by an adjusting member 33, the bellows 32a is in its contracted state, so that the ball valve body 32c closes a central hole 32f in the casing 32b. On the other hand, when the suction pressure Ps is not above the predetermined level, the bellows 32a is in its expanded state, so that the ball valve body 32c opens the central hole 32f. On this occasion, one of the high-pressure chambers $23_2$ is communicated with the suction chamber 11 via the passage 31, the mounting hole 34, a hole 32g formed in the casing 32b, a chamber 32h in the casing 32b and the central hole 32f in the casing 32b. A plunger 37 is inserted into a through hole 39 formed in the rear side block 4. Discharge pressure Pd introduced from the discharging space 20 via a high pressure-introducing hole 35 acts on the plunger 37, to keep same in contact with the ball valve body 32c, to urge the latter in its closing direction.

A torsional coiled spring 38 is arranged in the rear side block 4 and the rear head 6 with one end thereof retained by the rear head 6 and the other end engaged with the control element 24 to urge the control element 24 toward its minimum capacity position as shown in FIG. 7.

The operation of the variable capacity vane compressor constructed as above will now be described.

Figure 6:
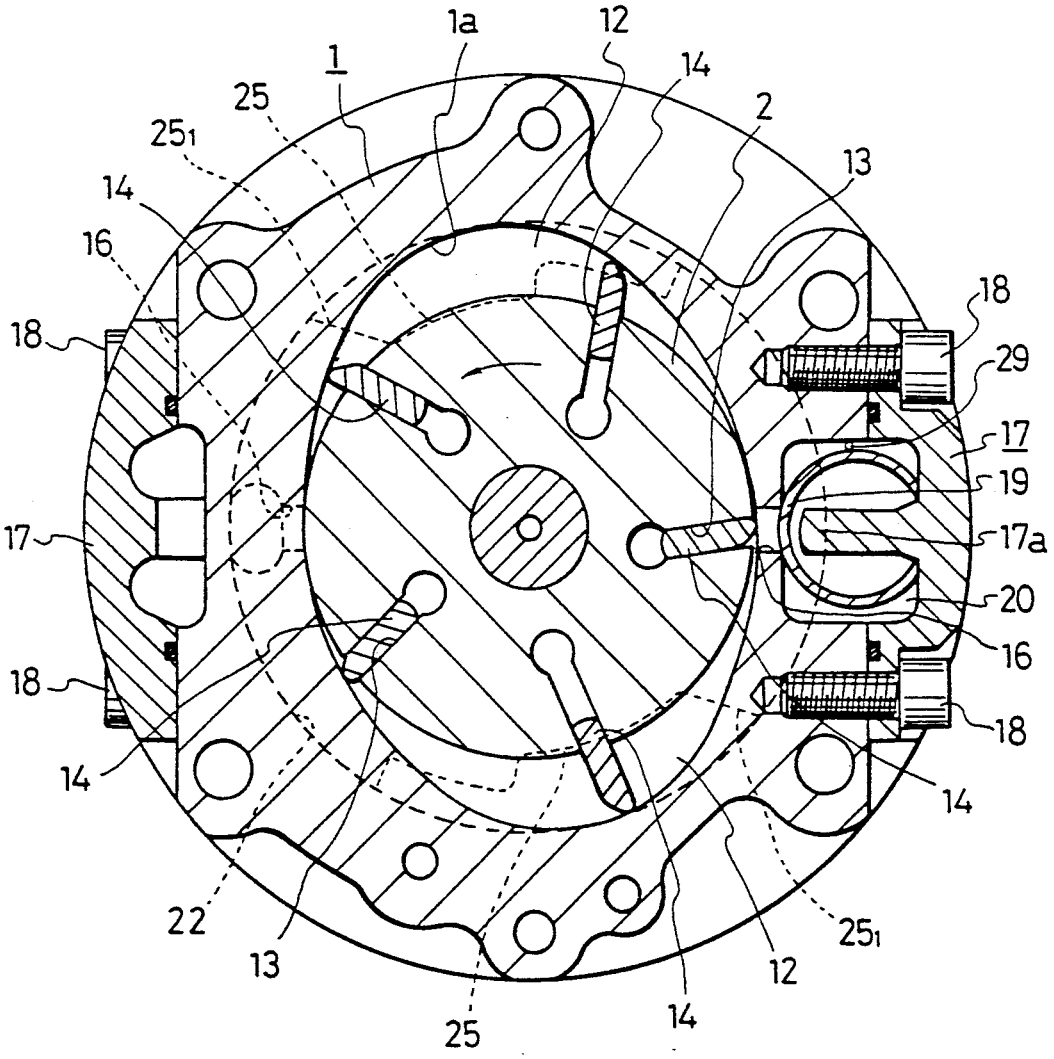
FIG. 6 is a view, similar to that of FIG. 5, showing the control element in its minimum capacity position.

In each compression space 12, the compression chamber on the suction stroke, which is defined between adjacent vanes, is supplied with refrigerant gas from the suction chamber 11 through the inlet port 15 and the associated cut-out portion 25 of the control element 24. Then, when the upstream one of the two adjacent vanes passes the downstream end $25_1$ of the cut-out portion 25 so that the compression chamber defined by the vanes becomes disconnected from the inlet port 15, compression is started. The compression starting timing becomes retarded as the control element 24 is circumferentially displaced from the maximum capacity position as shown in FIG. 5 toward the minimum capacity position shown in FIG. 6, whereby the delivery quantity or capacity is continuously decreased. In other words, then the control element is in the minimum capacity position, the downstream end $25_1$ of the cut-out portion 25 is positioned in the downstream extreme position in the direction of rotation of the rotor 2 and accordingly the compression is started at the latest timing. Consequenly, the volume of refrigerant gas trapped between the two adjacent vanes is the minimum and hence the delivery quantity is the minimum. On the other hand, when the control element is in the maximum capacity position, the downstream end $25_1$ of the cutout portion 25 is positioned in the upstream extreme position in the direction of rotation of the rotor to obtain the earliest compression starting timing so that the volume of refrigerant gas trapped between the two adjacent vanes is the maximum and hence the delivery quantity is the maximum. The control element 24 is rotated in opposite circumferential directions between the maximum capacity position and the minimum capacity position in response to the difference between the sum of the suction pressure Ps introduced into the low-pressure chamber $23_1$ and the urging force of the torsional coiled spring 38 and the control pressure Pc within the high-pressure chamber $23_2$. More specifically, when the suction pressure Ps is above the aforementioned predetermined value, the bellows 32a of the control valve device 32 is in its contracted state so that the ball valve body 32c closes the central hole 32f, i.e. the control valve device 32 is closed. This results in an increase in the control pressure Pc within the high-pressure chamber $23_2$, which in turn causes rotation of the control element 24 toward the maximum capacity position to increase the delivery quantity. As the discharge pressure increases, the force of the plunger 37 acting on the ball valve body 32c increases, so that the suction pressure Ps is controlled to a lower value. When the suction pressure Ps becomes equal to or lower than the predetermined value, the bellows 32*a* is expanded to cause the ball valve body 32*c* to open the central hole 33*f*, i.e. open the control valve device 33, whereby the control pressure Pc within the high-pressure chamber $23_2$ is allowed to leak into the suction chamber 11. This results in a decrease in the control pressure Pc, which in turn causes rotation of the control element 24 toward the minimum capacity position to decrease the delivery quantity. As the discharge pressure decreases, the force of the plunger 37 acting on the ball valve body 32*c* decreases, so that the suction pressure Ps is controlled to a higher value.

According to the bearing arrangement of the present invention, the control element 24 is guided during rotation thereof by the inner peripheral surface 45*a* of the annular member 45, so that the inner peripheral surfaces 46*c*, 46*d* of the respective annular projection 46*a* and race 46 which is force-fitted in the hole 24*b* of the control element are always kept out of contact with the outer peripheral surface of the drive shaft 7. This makes it possible to prevent occurrence of galling between the control element 24 and the drive shaft 7 when the drive shaft 7 rotates at a high speed or when the compressor is in a high load condition, and also reduce wear of the component members. Since the control element 24 is retained by the annular member 45 via the race 46, it is always kept in a position exactly at right angles to the axis of the drive shaft 7 as well as parallel with the opposed end face of the rotor 2, so that the clearance l can be maintained at the adjusted value, resulting in smooth rotation of the control element 24 and hence improved controllability of the compressor capacity. Further, the race 46 serves to absorb rotation of the control element 24 to prevent rotation of the race 44 due to the rotation of the control element 24 to thereby prevent wear of the annular recess 42 of the rear side block, so that the clearance l is not changed even after long-term use. Therefore, the control element is always kept parallel with the rotor, whereby rattling thereof is reduced, which results in improved durability of the compressor as well as improved controllability of the compressor capacity.

What is claimed is:

1. In a variable capacity vane compressor including a drive shaft, a rotor rigidly mounted on said drive shaft, a cylinder in which said rotor is rotatably received, said cylinder having a pair of side blocks, said side blocks each having formed therein a hole through which said drive shaft extends, a radial bearing mounted in said hole for supporting said drive shaft, one of said side blocks having an end face facing said rotor and having a first annular recess formed therein, a capacity control element rotatably fitted in said first annular recess for controlling timing of start of compression of a refrigerant gas in said compressor, said capacity control element having an end face remote from said rotor, and a hole through which said drive shaft extends, said hole of said one side block having a second annular recess formed in an inner peripheral surface thereof, said second annular recess having a first wall facing toward said rotor and a second wall facing toward said drive shaft, and bearing means comprising a thrust bearing received in said second annular recess and interposed between said end face of said control element remote from said rotor and said first wall of said second annular recess, said thrust bearing having first and second races, the improvement comprising:

an annular member force-fitted in said second wall of said second annular recess to urge said first race of said thrust bearing against said first wall of said second annular recess, said annular member having an inner peripheral surface in which said second race of said thrust bearing is slidably fitted, said second race being force-fitted in said hole of said capacity control element, said first and second races having respective inner peripheral surfaces thereof spaced from an outer peripheral surface of said drive shaft.

2. A variable capacity vane compressor according to claim 1, wherein said second race has an end face facing toward said rotor, and an annular projection formed integrally on said end face thereof, said annular projection being force-fitted in said hole of said capacity control element.

3. A variable capacity vane compressor according to claim 1, wherein said second race and said annular member are formed of hardened steel.

4. A variable capacity vane compressor according to claim 2, wherein said second race and said annular member are formed of hardened steel.

* * * * *